United States Patent [19]

Townsend

[11] 4,045,020

[45] Aug. 30, 1977

[54] OCCUPANT-PROPELLED ROUND ABOUT

[76] Inventor: Raymond Townsend, 61 Dragon St., Warwick, Australia

[21] Appl. No.: 598,154

[22] Filed: July 22, 1975

[51] Int. Cl.[2] ..... A63G 1/20

[52] U.S. Cl. ..... 272/33 R

[58] Field of Search ..... 272/33 R, 33 A, 33 B, 272/39, 40, 41, 42, 52, 52.5, 30, 36

[56] References Cited

U.S. PATENT DOCUMENTS

| | | | |
|---|---|---|---|
| 1,010,537 | 12/1911 | Tuttle | 272/33 R |
| 1,047,149 | 12/1912 | Barlow | 272/52 UX |
| 2,189,239 | 2/1940 | Brewster, Sr. | 272/40 X |
| 2,943,854 | 7/1960 | Levinson | 272/33 R |
| 2,996,298 | 8/1961 | Gross et al. | 272/52 |
| 3,018,101 | 1/1962 | Mir et al. | 272/33 R |
| 3,155,388 | 11/1964 | Walden | 272/33 R |

*Primary Examiner*—Richard C. Pinkham
*Assistant Examiner*—Arnold W. Kramer

[57] ABSTRACT

An amusement ride includes a frame which is rotatable about a fixed vertical standard, and on the frame one or more seats is or are mounted for rocking or oscillation about a horizontal axis or axes. A drive mechanism is operatively connected between the seat, or each of them, and the standard, in such manner that oscillation of a seat causes the frame carrying the seat or seats to be rotated in one direction about the standard.

2 Claims, 3 Drawing Figures

FIG. 2.
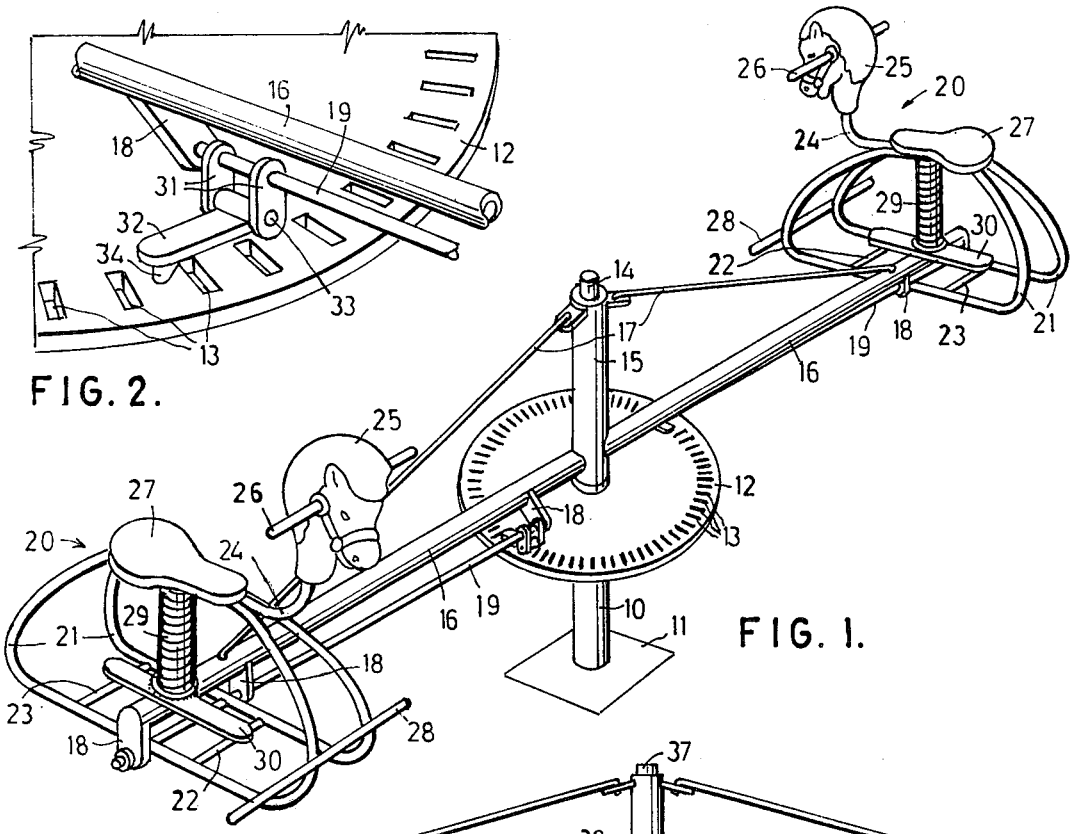
FIG. 1.
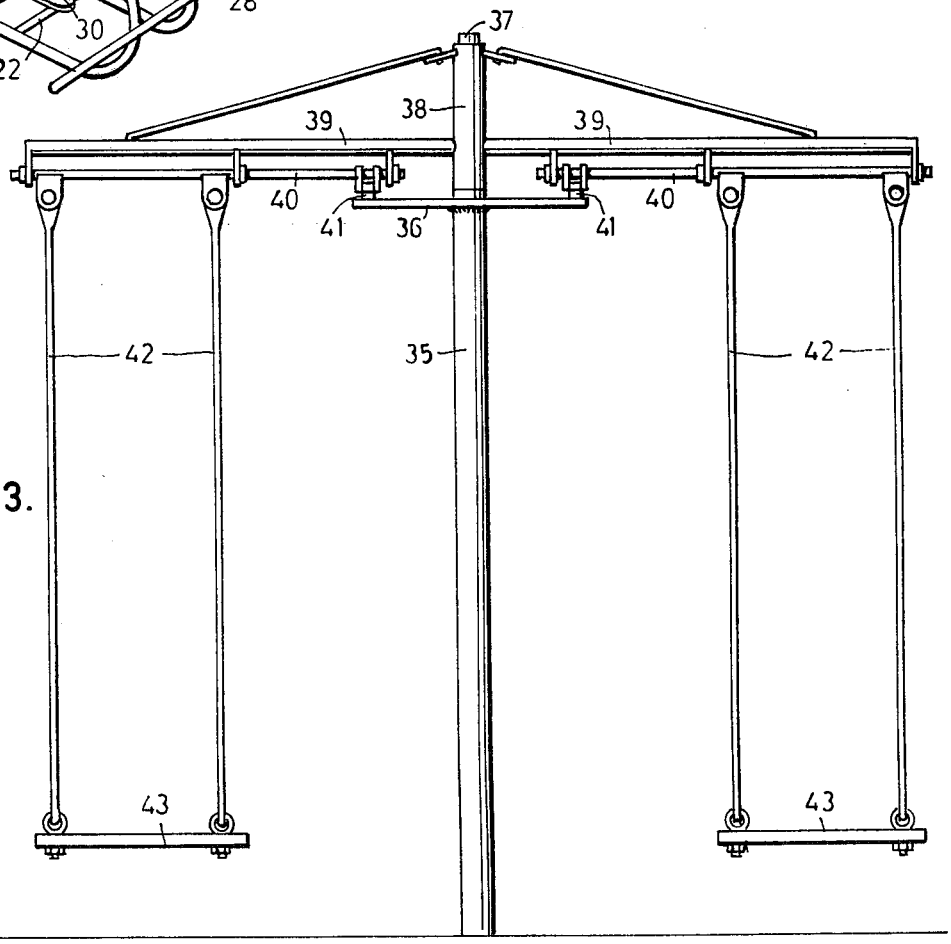
FIG. 3.

OCCUPANT-PROPELLED ROUND ABOUT

BACKGROUND OF THE INVENTION

This invention relates to an improved amusement ride, particularly for children, and usable either as permanently sited playground equipment or for domestic use.

Rides of roundabout type are, of course, well known playground equipment, and may be rotated by children who may then jump upon them to enjoy the rotary movement; and many kinds of playground equipment on which children may swing or rock are also well known.

SUMMARY OF THE INVENTION

The present invention has been devised with the object of providing an amusement ride, which is particularly enjoyable for children, combining a rocking or swinging motion with a roundabout type of ride, the rocking or swinging causing a roundabout motion.

With this object in view, the invention resides broadly in an amusement ride including a standard, a frame axis, a seating unit mounted on the rotatable frame for oscillation about a substantially horizontal axis, and actuating means operatively interconnecting the seating unit to the standard in such manner that oscillation of the seating unit drives the rotatable frame and the seating unit mounted thereon to rotate about the standard.

Preferably at least two seating units are provided, of the nature of rocking horses, and the actuating means includes a horizontal shaft on which each seating unit is secured and about which it is oscillatable, the shaft carrying a detent which coacts with a fixed ratchet wheel on the standard in such manner that when the seating unit is rocked or oscillated in one direction, rotary motion is imparted to the rotatable frame. Other features of the invention will become apparent from the following description.

BRIEF DESCRIPTION OF THE DRAWINGS

In order that preferred embodiments of the invention may be readily understood and carried into practical effect, reference is now made to the accompanying drawings, wherein:

FIG. 1 is a perspective view of an amusement ride according to one embodiment of the invention, FIG. 2 is a perspective detail drawing showing one of the pawl assemblies of the device, and FIG. 3 is an elevational view of an alternative embodiment of the invention.

DETAILED DESCRIPTION OF THE INVENTION

Referring initially to FIGS. 1 and 2 of the drawings, the amusement ride includes a vertical tubular metal standard 10, the lower end of which is set in concrete 11 in a hole in the ground. A ratchet wheel 12 is mounted fixedly on the standard 10, and consists of a metal disc centrally apertured to receive the upper end of the standard 10, to which it is rigidly secured coaxially. Near to its edge, the disc is formed with a series of equally spaced slotted holes 13, equidistantly spaced from the centre of the disc.

A spindle 14 is closely fitted and secured in the upper part of the standard and extends upwardly therefrom.

The device includes a rotatable frame, comprising a tubular hub 15, rotatably mounted on the spindle 14, and from which there extends a pair of diametrically opposed radial carrier arms 16, of metal tubing, braced by stays 17 from the top of the hub 15.

Secured to each of the carrier arms 16 are apertured lugs 18 provided with bearings for an actuating shaft 19 below the respective carrier arm.

A rocking horse 20 is fixedly mounted on the outer part of each actuating shaft 19, each rocking horse including a metal tube frame composed of two substantially trapezium-shaped side frames 21, the actuating shaft being rigidly secured transversely to the central bottom parts of the side frames, which are further interconnected by front and rear cross members 22 and 23. The upper parts of the side frames are secured to both sides of a central tubular member 24 which is curved up in front and has a head 25 mounted thereon, with a pair of handles 26.

A seat 27 is secured on the rocking horse frame, and a foot rest bar 28 is secured across the lower front parts of the two side frames 21. A helical spring 29 is secured at its lower end on the carrier arm 16, and at its upper end to the rocking horse frame under the saddle, acting to bias the rocking horse normally to upright position, as shown. However, the rocking horse may be oscillated, or swung forwards and backwards, distorting the spring 29, this movement of the rocking horse being limited by a stop bar 30 secured to and extending forwardly and rearwardly of the carrier arm 16, to limit the upward movement of the front and rear cross members 22 and 23.

Each actuating shaft 19 has secured near to its inner end a pair of downwardly extending levers 31, between the lower ends of which a pawl 32 is pivoted at one end about a pin 33 parallel to the actuating shaft. At its other end, the pawl is provided with a downwardly extending tooth or detent 34 for engagement with the slots 13 of the ratchet wheel 12. The parts are so made and arranged that as either rocking horse 20 is swung rearwardly, the actuating shaft 19 is turned to move the pawl 32 slidably forward, the tooth 34 riding over slotted holes 13; and when the rocking horse 20 is swung forwardly, the tooth 34 of the pawl 32 engages in a hole 13 preventing reverse movement of the pawl relative to the ratchet wheel 12, with the result that the rotatable assembly of carrier arms 16, hub 15, rocking horses 20 and associated parts is caused to turn about the spindle 14. In this manner, one rider or two may operate the roundabout-like device by rocking one rocking horse or both.

Each actuating shaft 19 is somewhat skewed in relation to the carrier arm 16 under which it is mounted, so that the pawl 32 will exert thrust on the ratchet wheel 12 substantially perpendicularly to a radius of the wheel.

In a possible modification of the invention as shown in FIG. 3, high standard 35 has secured coaxially on its upper end a ratchet wheel 36, as before described, and a spindle 37 extending coaxially above the standard carries a rotatable frame comprising a hub 38 from which a pair of diametrically opposed carrier arms 39 extend horizontally. Under each of the carrier arms 39, an actuating shaft 40 is rotatably mounted and, at its inner end, is provided with a pawl 41 as before described for engagement with a series of holes (not shown) near the periphery of the ratchet wheel 36. From the outer part of each carrier arm 39 there are suspended a pair of hanger rods 42 for a swing seat 43, the connection of the hanger bars to the actuating shaft and seat being such that the seat may be swung outwardly in the direction away from the standard 35, but forward and rearward swinging of the seat causes oscillation of the actuating shaft 40. When two children use the swings, the rotatable frame with the suspended swing seats 43 and associated parts are caused to rotate about the spindle 37 of the standard 35.

In either form of the invention, the rotatable frame may be made to carry more than two of the seating units. The required number of carrier arms may radiate from a central hub or, when the amusement ride, as shown in FIG. 1, has seating units above the actuating shafts, the rotatable frame may be in the form of a substantially circular platform.

What I claim is:

1. An amusement ride comprising:

a. a standard;

b. a frame rotatable on said standard about a substantially vertical axis;

c. a seating unit mounted on said frame for oscillation about a substantially horizontal axis;

d. a ratchet wheel fixedly mounted on said standard coaxially therewith;

e. an actuating shaft mounted on said frame, said actuating shaft supporting said seating unit and being fixed for oscillation therewith, and said seating unit including a rocking horse secured above said actuating shaft, spring means between said rocking horse and said frame to bias said rocking horse to an upright position, and stop means for limiting oscillation of said rocking horse in both directions; and f. a detent on said shaft to coact with said wheel so that each oscillatory movement of said seating unit in one direction imparts rotary motion to said frame.

2. An amusement ride comprising:

a. a substantially vertical standard;

b. a hub rotatable on said standard;

c. a rotatable frame including a plurality of carrier arms fixed to and radiating from said hub;

d. a substantially horizontal actuating shaft mounted for oscillation on each arm;

e. a seating unit mounted on and fixed for oscillation with each shaft, each seating unit including a rocking horse secured above the respective actuating shaft, spring means between the rocking horse and the respective carrier arm to bias the rocking horse to an upright position, and stop means for limiting the oscillation of the rocking horse in both directions;

f. a ratchet wheel fixedly secured coaxially on said standard; and g. a detent on each shaft to coact with said wheel so that each oscillatory movement of said seating unit and of said shaft in one direction imparts rotary motion to said hub and to said arms.

* * * * *